US008594530B2

(12) United States Patent
Sato et al.

(10) Patent No.: US 8,594,530 B2
(45) Date of Patent: Nov. 26, 2013

(54) IMAGE FORMING APPARATUS

(75) Inventors: Shougo Sato, Seto (JP); Hiroshi Nakano, Nagoya (JP); Hirotaka Mori, Nagoya (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 77 days.

(21) Appl. No.: 13/349,610

(22) Filed: Jan. 13, 2012

(65) Prior Publication Data

US 2012/0183320 A1 Jul. 19, 2012

(30) Foreign Application Priority Data

Jan. 14, 2011 (JP) ..... 2011-005940

(51) Int. Cl.
*G03G 21/00* (2006.01)

(52) U.S. Cl.
USPC ..... 399/110; 399/107

(58) Field of Classification Search
CPC ..... G03G 21/00
USPC ..... 399/107, 110
See application file for complete search history.

(56) References Cited

U.S. PATENT DOCUMENTS 5,182,595 A * 1/1993 Fukuchi et al. ..... 399/21
5,201,854 A * 4/1993 Ahl et al. ..... 439/247
5,662,320 A * 9/1997 Fujiwara et al. ..... 271/3.14
5,893,662 A * 4/1999 Ito ..... 399/110
6,708,011 B2 * 3/2004 Nomura et al. ..... 399/110
7,447,467 B2 11/2008 Kamimura et al.
7,526,227 B2 * 4/2009 Sato et al. ..... 399/110
7,720,413 B2 5/2010 Kamimura et al.
7,817,936 B2 * 10/2010 Kikuchi et al. ..... 399/110
8,000,628 B2 8/2011 Sato et al.
8,064,793 B2 11/2011 Kamimura et al.
8,126,356 B2 * 2/2012 Watanabe et al. ..... 399/110
8,150,294 B2 * 4/2012 Okabe et al. ..... 399/118

(Continued)

FOREIGN PATENT DOCUMENTS

JP 08-036346 2/1996
JP 2003-043776 2/2003

(Continued)

OTHER PUBLICATIONS

JP Office Action mailed Mar. 5, 2013, JP Appln. 2011-005940, English translation.

*Primary Examiner* — Clayton E Laballe
*Assistant Examiner* — Kevin Butler
(74) *Attorney, Agent, or Firm* — Banner & Witcoff, Ltd.

(57) ABSTRACT

An image forming apparatus includes: a plurality of photoconductor drums; a plurality of exposure members; a drum supporting member having a pair of side walls disposed opposite to each other in an axial direction of the photoconductor drum and configured to support the photoconductor drums and the exposure members between the side walls; a belt disposed below and opposite to the photoconductor drums; a pair of guide members configured to support the drum supporting member while allowing rectilinear movement of the drum supporting member; a separation mechanism configured to support the guide members together with the drum supporting member such that the photoconductor drums are movable in an upward-and-downward direction; and a main body circuit board provided in the main body and connected to the exposure members via a flat cable. The flat cable is partly supported at its retained portion by at least one of the guide members.

12 Claims, 10 Drawing Sheets

(56) References Cited

U.S. PATENT DOCUMENTS

| | | | | |
|---|---|---|---|---|
| 8,175,490 | B2 | 5/2012 | Sato et al. | |
| 8,180,257 | B2 * | 5/2012 | Matsunai | 399/207 |
| 8,200,119 | B2 * | 6/2012 | Okabe et al. | 399/110 |
| 8,229,318 | B2 * | 7/2012 | Nakajima et al. | 399/110 |
| 8,265,520 | B2 * | 9/2012 | Irie et al. | 399/110 |
| 8,265,522 | B2 | 9/2012 | Kamimura et al. | |
| 8,311,437 | B2 | 11/2012 | Sato | |
| 8,364,056 | B2 * | 1/2013 | Miyahara | 399/101 |
| 8,369,735 | B2 | 2/2013 | Sato et al. | |
| 8,401,423 | B2 * | 3/2013 | Suzuki | 399/111 |
| 2003/0053819 | A1 | 3/2003 | Nomura et al. | |
| 2006/0067734 | A1 * | 3/2006 | Igarashi et al. | 399/119 |
| 2006/0140673 | A1 | 6/2006 | Kamimura et al. | |
| 2007/0160384 | A1 * | 7/2007 | Sakurai et al. | 399/110 |
| 2007/0160385 | A1 * | 7/2007 | Noguchi et al. | 399/110 |
| 2008/0036140 | A1 * | 2/2008 | Inoue | 271/265.01 |
| 2008/0124118 | A1 * | 5/2008 | Ukai et al. | 399/110 |
| 2008/0219696 | A1 | 9/2008 | Itabashi | |
| 2009/0028602 | A1 | 1/2009 | Kamimura et al. | |
| 2009/0142092 | A1 * | 6/2009 | Sato | 399/111 |
| 2009/0166956 | A1 * | 7/2009 | Kajiyama | 271/164 |
| 2009/0169228 | A1 * | 7/2009 | Yokoi et al. | 399/51 |
| 2009/0190953 | A1 | 7/2009 | Okabe | |
| 2009/0226205 | A1 | 9/2009 | Sato et al. | |
| 2010/0080615 | A1 * | 4/2010 | Kikuchi | 399/111 |
| 2010/0166455 | A1 * | 7/2010 | Mori et al. | 399/113 |
| 2010/0209140 | A1 | 8/2010 | Kamimura et al. | |
| 2011/0157295 | A1 * | 6/2011 | Sakamoto | 347/224 |
| 2011/0182612 | A1 * | 7/2011 | Kamimura et al. | 399/110 |
| 2011/0222902 | A1 * | 9/2011 | Miyahara | 399/101 |
| 2011/0255902 | A1 | 10/2011 | Sato et al. | |
| 2011/0280617 | A1 * | 11/2011 | Iino et al. | 399/110 |
| 2011/0299883 | A1 * | 12/2011 | Suzuki | 399/110 |
| 2012/0027472 | A1 | 2/2012 | Kamimura et al. | |
| 2012/0076531 | A1 * | 3/2012 | Awano et al. | 399/107 |
| 2012/0114374 | A1 * | 5/2012 | Suzuki | 399/111 |
| 2012/0183319 | A1 * | 7/2012 | Sato et al. | 399/110 |
| 2012/0183320 | A1 * | 7/2012 | Sato et al. | 399/110 |
| 2012/0183321 | A1 * | 7/2012 | Mori et al. | 399/110 |
| 2012/0183322 | A1 * | 7/2012 | Sato et al. | 399/110 |
| 2012/0183323 | A1 * | 7/2012 | Nakano et al. | 399/110 |
| 2012/0183324 | A1 * | 7/2012 | Sato et al. | 399/110 |
| 2012/0183325 | A1 * | 7/2012 | Sato et al. | 399/110 |
| 2012/0195625 | A1 | 8/2012 | Sato et al. | |
| 2012/0207504 | A1 * | 8/2012 | Hamaya | 399/88 |
| 2012/0207511 | A1 * | 8/2012 | Sato | 399/110 |
| 2012/0263493 | A1 * | 10/2012 | Okabe et al. | 399/110 |
| 2012/0308273 | A1 | 12/2012 | Kamimura et al. | |
| 2013/0004201 | A1 | 1/2013 | Sato | |

FOREIGN PATENT DOCUMENTS

| | | | |
|---|---|---|---|
| JP | 2005-342979 | A | 12/2005 |
| JP | 2006-098772 | | 4/2006 |
| JP | 2006-184552 | A | 7/2006 |
| JP | 2008-224837 | | 9/2008 |
| JP | 2009-139495 | | 6/2009 |
| JP | 2009-157135 | | 7/2009 |
| JP | 2009-157135 | A | 7/2009 |
| JP | 2009-175416 | | 8/2009 |
| JP | 2009-189886 | A | 8/2009 |
| JP | 2009-210937 | A | 9/2009 |

* cited by examiner

IMAGE FORMING APPARATUS

CROSS-REFERENCE TO RELATED APPLICATION(S)

This application claims priority from Japanese Patent Application No. 2011-005940 filed on Jan. 14, 2011, the disclosure of which is incorporated herein by reference in its entirety.

TECHNICAL FIELD

The present invention relates to an image forming apparatus with a drum supporting member configured to support a plurality of photoconductor drums and exposure members.

BACKGROUND ART

There is known an image forming apparatus which includes a plurality of photoconductor drums, a plurality of LED heads (exposure members) configured to expose the plurality of photoconductor drums to light, a drum supporting member configured to support the photoconductor drums and the LED heads and allowed to be pulled out from a main body of the image forming apparatus, and a control circuit board provided in the main body and connected to the LED heads via a flat cable. According to this image forming apparatus, the photoconductor drums are supported at an upper part of the drum supporting member and the LED heads are supported by the drum supporting member at positions lower than the photoconductor drums.

Further, an intermediate transfer belt is arranged over and in contact with the photoconductor drums, and the control circuit board is disposed below the drum supporting member. The flat cable connecting the LED heads and the control circuit board is folded into a U-shape, as viewed from side, with its open end facing toward the front side of the image forming apparatus.

With this configuration of the conventional image forming apparatus, the drum supporting member is pulled out from the main body firstly by lowering the drum supporting member so that the photoconductor drums are moved away from the intermediate transfer belt, and then by pulling out the drum supporting member forward. During this pull-out operation, the U-shaped folded flat cable is firstly pulled in the upward-and-downward direction and then moved in the front-and-rear direction to unfold and straighten the folded cable.

SUMMARY OF THE INVENTION

The inventors of the present invention attempt to develop a structure in which a belt, such as an intermediate transfer belt, is disposed between the drum supporting member and the control circuit board. However, according to this structure, the distance between the drum supporting member and the control circuit board is increased by the amount corresponding to the belt disposed therebetween, and the distance is further increased when the photoconductor drums supported by the drum supporting member are moved away from the belt.

For this reason, if the drum supporting member and the control circuit board are directly connected by a flat cable in this structure, the pull-out operation of the drum supporting member from the main body causes the flat cable to be firstly pulled in the upward-and-downward direction and then moved in the front-and-read direction, with the result that the trajectory of the flat cable becomes larger and the flat cable may interfere with other parts.

In view of the above, it would be desirable to provide an image forming apparatus in which the trajectory of the flat cable can be made smaller even if the distance between the control circuit board and the drum supporting member is greater.

According to the present invention, an image forming apparatus comprises: a plurality of photoconductor drums; a plurality of exposure members each configured to expose a corresponding photoconductor drum to light to form an electrostatic latent image on the photoconductor drum; a drum supporting member having a pair of side walls disposed opposite to each other in an axial direction of the photoconductor drum and configured to support the plurality of photoconductor drums and the plurality of exposure members between the side walls; a belt disposed below and opposite to the photoconductor drums; a pair of guide members configured to support the drum supporting member while allowing rectilinear movement of the drum supporting member between a retracted position in which the drum supporting member is received in a main body of the image forming apparatus and a pull-out position to which the drum supporting member is moved from the retracted position and pulled out from the main body through an opening formed in the main body; a separation mechanism configured to support the guide members together with the drum supporting member such that the photoconductor drums are movable in an upward-and-downward direction between a contacting position in which the photoconductor drums contact the belt and a spaced-apart position in which the photoconductor drums are away from the belt; and a main body circuit board provided in the main body and connected to the plurality of exposure members via a flat cable. In this image forming apparatus, the flat cable is partly supported at its retained portion by at least one of the guide members.

BRIEF DESCRIPTION OF THE DRAWINGS

To better understand the claimed invention, and to show how the same may be carried into effect, reference will now be made, by way of example only, to the accompanying drawings, in which:

DESCRIPTION OF EMBODIMENT

Figure 1:
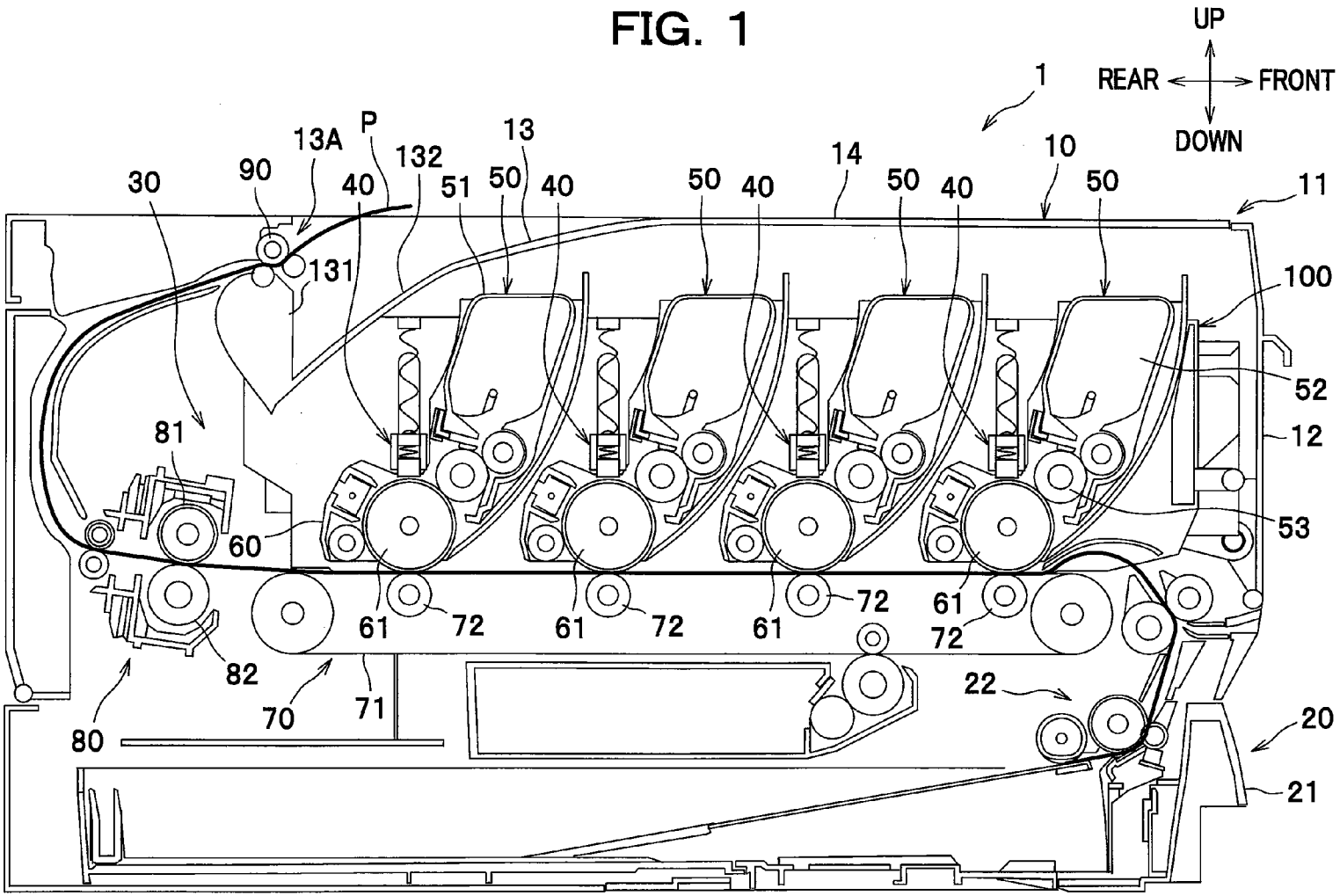
FIG. 1 is a schematic sectional view of a color printer according to one exemplary embodiment of the present invention.

A detailed description will be given of an illustrative embodiment of the present invention with reference to the accompanying drawings. In the following description, a general arrangement of a color printer as an example of an image forming apparatus will be described, and thereafter characteristic features of the present invention will be described in detail.

In the following description, the direction is designated as from the viewpoint of a user who is using (operating) the color printer. To be more specific, in FIG. 1, the right-hand side of the drawing sheet corresponds to the "front" side of the color printer, the left-hand side of the drawing sheet corresponds to the "rear" side of the color printer, the front side of the drawing sheet corresponds to the "left" side of the color printer, and the back side of the drawing sheet corresponds to the "right" side of the color printer. Similarly, the direction extending from top to bottom of the drawing sheet corresponds to the "vertical" or "upward-and-downward (up/down, upper/lower or top/bottom)" direction of the color printer. For ease of reference, hatching is used in sectional views only where it seems necessary.

As seen in FIG. 1, a color printer 1 includes a main body casing 10 as an example of a main body, and several components housed within the main body casing 10 which include a sheet feeder unit 20 for feeding a sheet of paper P (hereinafter simply referred to as a "sheet" P) as an example of a recording sheet, and an image forming unit 30 for forming images corresponding to four colors of black (K), cyan (C), magenta (M), and yellow (Y) on the supplied sheet P to stack these colors one on top of another.

The main body casing 10 has a front wall, and an opening 11 (see FIG. 3) is formed in the front wall (front side of the main body casing 10). A front cover 12 is pivotally supported on the main body casing 10 to open and close the opening 11. To be more specific, the front cover 12 is swingable (movable) between a closed position (i.e., position shown in FIG. 1) in which the opening 11 is closed by the cover 12 and an opened position (i.e., position shown in FIG. 3) in which the opening 11 is left open.

The sheet feeder unit 20 includes a sheet feed tray 21 for storing sheets P, and a sheet conveyance device 22 for conveying a sheet P from the sheet feed tray 21 to the image forming unit 30.

The image forming unit 30 includes four LED arrays 40 as an example of a plurality of exposure members, four process cartridges 50, a transfer unit 70, and a fixing unit 80.

Each LED array 40 comprises a plurality of LEDs fabricated on a semiconductor chip, and is configured to expose a photoconductor drum 61 to be described later to light along a main scanning direction, that is an axial direction of the photoconductor drum 61. Four LED arrays 40 corresponding to respective colors are supported by a drawer 100 as an example of a drum supporting member to be described later and positioned adjacent to and at positions higher than four photoconductor drums 61 provided corresponding to the respective colors.

The process cartridges 50 are arranged in tandem in the front-and-rear direction. Each process cartridge 50 comprises a development cartridge 51, and a drum cartridge 60 disposed under the development cartridge 51. The process cartridges 50 are detachably mounted to the drawer 100.

The development cartridge 51 includes a toner receptacle 52 for storing toner as an example of developer, a development roller 53 for supplying toner stored in the toner receptacle 52 to the photoconductor drum 61, and other components such as a supply roller (reference numeral omitted) and a doctor blade (reference numeral omitted). The four development cartridges 51 store different colors of toner corresponding to the four photoconductor drums 61. The four development cartridges 51 are disposed adjacent to the corresponding photoconductor drums 61 at diagonally upward and frontward positions, and detachably mounted to the corresponding drum cartridges 60.

The drum cartridge 60 includes a photoconductor drum 61, and other components such as a known charger (reference numeral omitted). The four drum cartridges 60 are detachably mounted to the drawer 100 to be described later.

The transfer unit 70 is arranged between the sheet feeder unit 20 and the photoconductor drums 61. The transfer unit 70 includes an endless conveyor belt 71 looped around a plurality of rollers, and four transfer rollers 72. The conveyor belt 71 is disposed below and opposite to the plurality of photoconductor drums 61. The transfer rollers 72 are disposed inside the conveyor belt 71 such that the conveyor belt 71 is nipped between the photoconductor drums 61 and the transfer rollers 72.

The fixing unit 80 is arranged at the rear of the process cartridges 50 and the transfer unit 70. The fixing unit 80 includes a heating roller 81, and a pressure roller 82 positioned opposite to the heating roller 81 and pressed against the heating roller 81.

According to the image forming unit 30 configured as described above, the surface of each photoconductor drum 61 is uniformly charged by the charger, and then exposed to light by the LED array 40. Accordingly, the electric potential of the exposed area lowers and an electrostatic latent image associated with image data is formed on the surface of each photoconductor drum 61. Thereafter, toner is supplied from the development roller 53 onto the electrostatic latent image, so that a toner image is carried on the photoconductor drum 61.

Toner images formed on the plurality of photoconductor drums 61 are transferred onto a sheet P while the sheet P is conveyed on the conveyor belt 71 and passes between the photoconductor drums 61 and the transfer rollers 72. When the sheet P passes between the heating roller 81 and the pressure roller 82, the toner images transferred onto the sheet P are thermally fixed.

The sheet P with the toner images thermally fixed thereon by the fixing unit 80 is ejected out from the main body casing 10 by sheet output rollers 90 disposed downstream from the fixing unit 80 in a sheet conveyance direction along which the sheet P is conveyed. The sheet P thus ejected is accumulated on a sheet output tray portion 13 formed on an upper wall 14 of the main body casing 10. The upper wall 14 of the main body casing 10 is recessed at the center part in the right-and-left direction to form the sheet output tray portion 13, so that a space is formed in the main body casing 10 at each side of the sheet output tray portion 13 (i.e., at each side of the photoconductor drums 61 in their axial direction).

To be more specific, the sheet output tray portion 13 includes a first wall 131 extending perpendicularly downward from the upper wall 14 of the main body casing 10 and having an ejection opening 13A for ejecting sheets P, and a second wall 132 extending diagonally upward and frontward from the lower end of the first wall 131 toward the upper wall 14 and having an upwardly projecting arcuate cross-section.

Structure of Drawer 100 and Therearound

Next, a structure around the drawer 100 will be described in detail.

Figure 2:
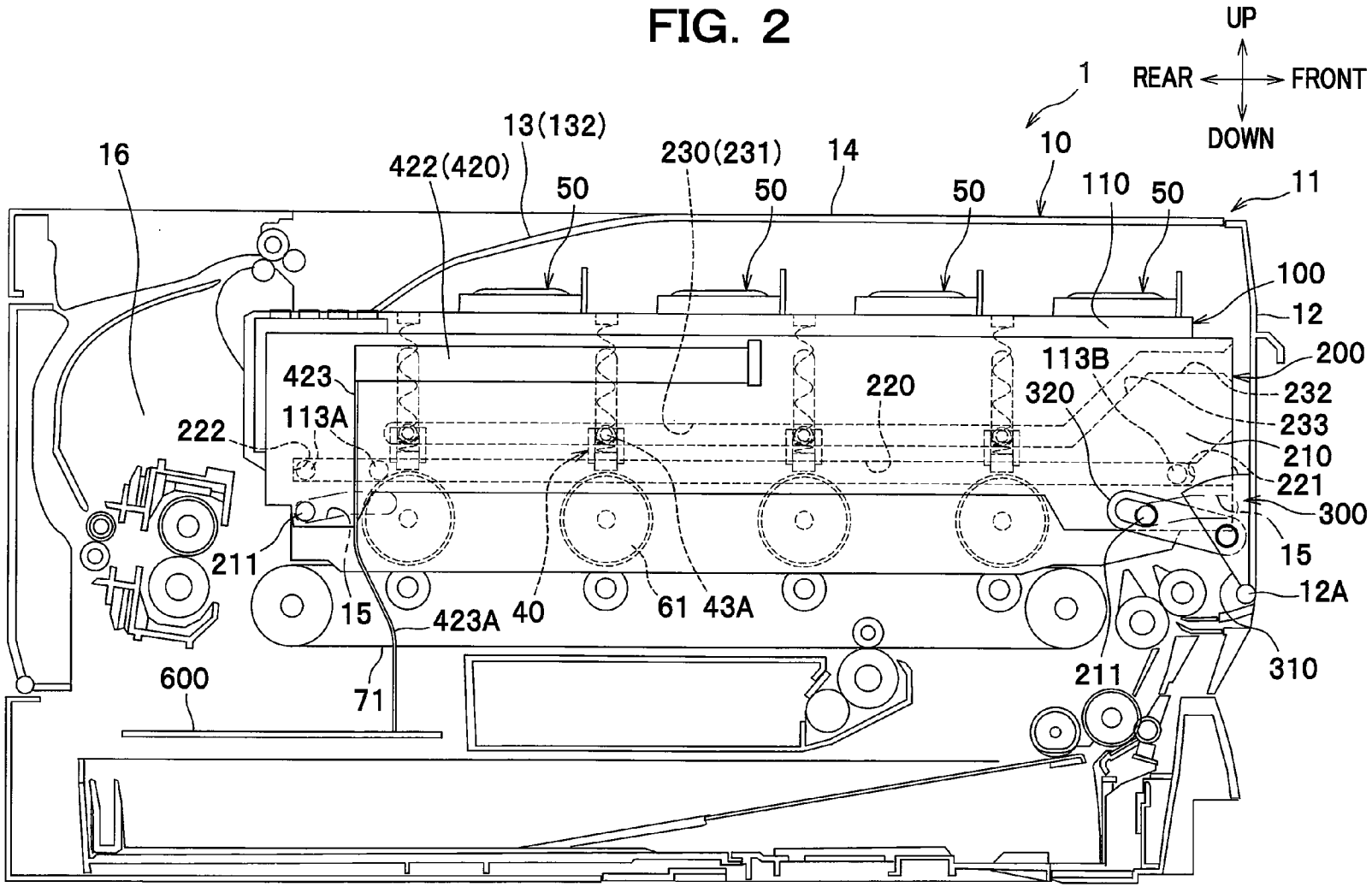
FIG. 2 is a sectional view showing positions of a drawer and a guide member when the front cover is in a closed position.
Figure 3:
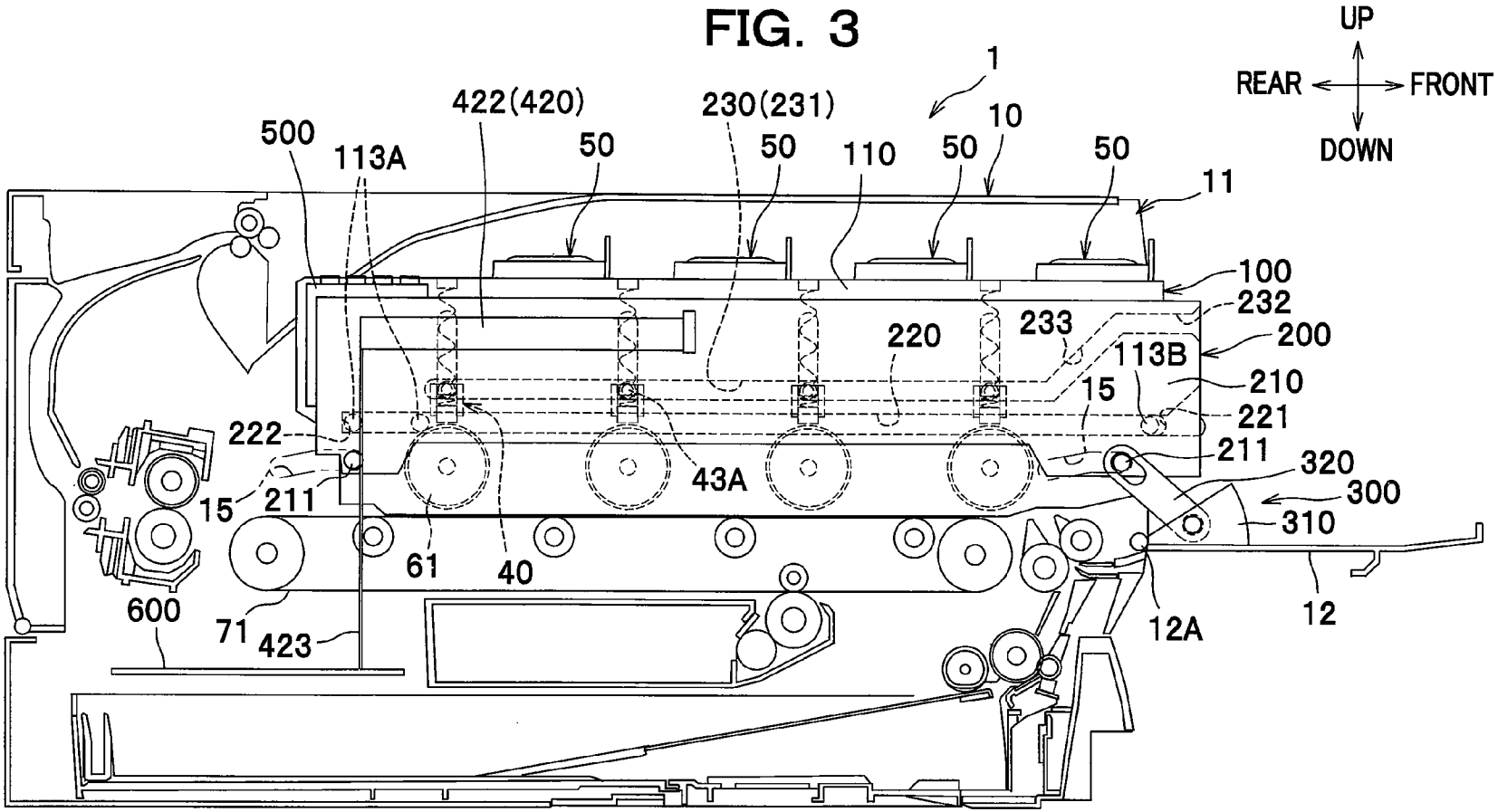
FIG. 3 is a sectional view showing the positions of the drawer and the guide member when the front cover is in an opened position.
Figure 4:
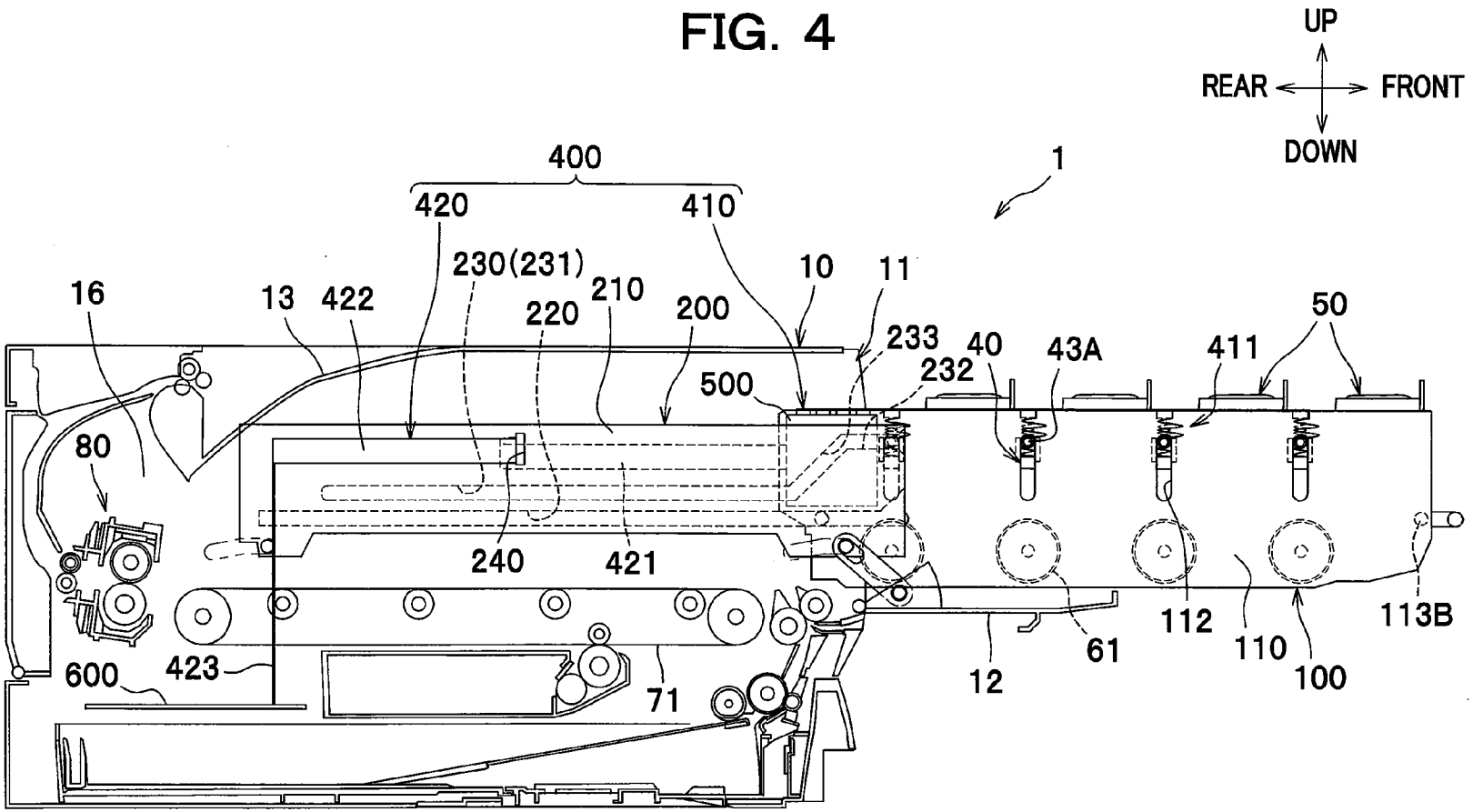
FIG. 4 is a sectional view showing a state in which the drawer has been pulled out from the main body casing.

As best seen in FIGS. 2 to 4, the drawer 100 is configured to be movable in the front-and-rear direction between a retracted position (i.e., position shown in FIG. 3) in which the drawer 100 is received in the main body casing 10 and a pull-out position (i.e., position shown in FIG. 4) in which the drawer 100 has been moved from the retracted position through the opening 11 formed in the main body casing 10 outside the main body casing 10. Namely, the drawer 100 is allowed to be pulled out forward in a sheet output direction along which the sheet P is discharged with respect to the sheet output tray portion 13.

To be more specific, opening the front cover 12 causes the drawer 100 to be moved upward, and from this lifted-up position, the drawer 100 can be pulled out forward through the opening 11. In other words, the drawer 100 is movable in the upward-and-downward direction (i.e., optical axis direction of the LED arrays 40) as well as in the front-and-rear direction (i.e., direction along which the plurality of photoconductor drums 61 are arranged).

The LED arrays 40 disposed in the drawer 100 are moved upward and downward in accordance with forward and rearward movements of the drawer 100. To be more specific, when the drawer 100 is positioned in the retracted position, the plurality of LED arrays 40 are positioned in an exposure position (i.e., position shown in FIG. 3) in which the LED arrays 40 are positioned adjacent to the photoconductor drums 61, and when the drawer 100 is positioned in the pull-out position, the LED arrays 40 are positioned in a retreating position (i.e., position shown in FIG. 4) in which the LED arrays 40 are away from the photoconductor drums 61 and engaged with stopper portions (e.g., upper ends of oblong holes 112 to be described later).

The LED arrays 40 are located in the drawer 100 when they are in the exposure position and in the retreating position. Namely, the LED arrays 40 are configured not to protrude beyond the drawer 100 when they are in the exposure position as well as in the retreating position. Accordingly, the plurality of LED arrays 40 can be protected from the user and other parts.

To be more specific, the main body casing 10 includes the drawer 100, a pair of right and left guide members 200 configured to support the drawer 100 while allowing rectilinear movement of the drawer 100 in the front-and-rear direction, and a pair of right and left interlocking mechanisms 300 configured to cause the pair of guide members 200 to move diagonally upward and frontward or to move diagonally downward and rearward in synchronization with the opening and closing operation of the front cover 12.

Since parts such as the guide members 200 and the interlocking mechanisms 300 are arranged at right and left sides and each having a symmetrical configuration, only one of the parts will be described in the following description and description to the other of the parts will be omitted.

Figure 5:
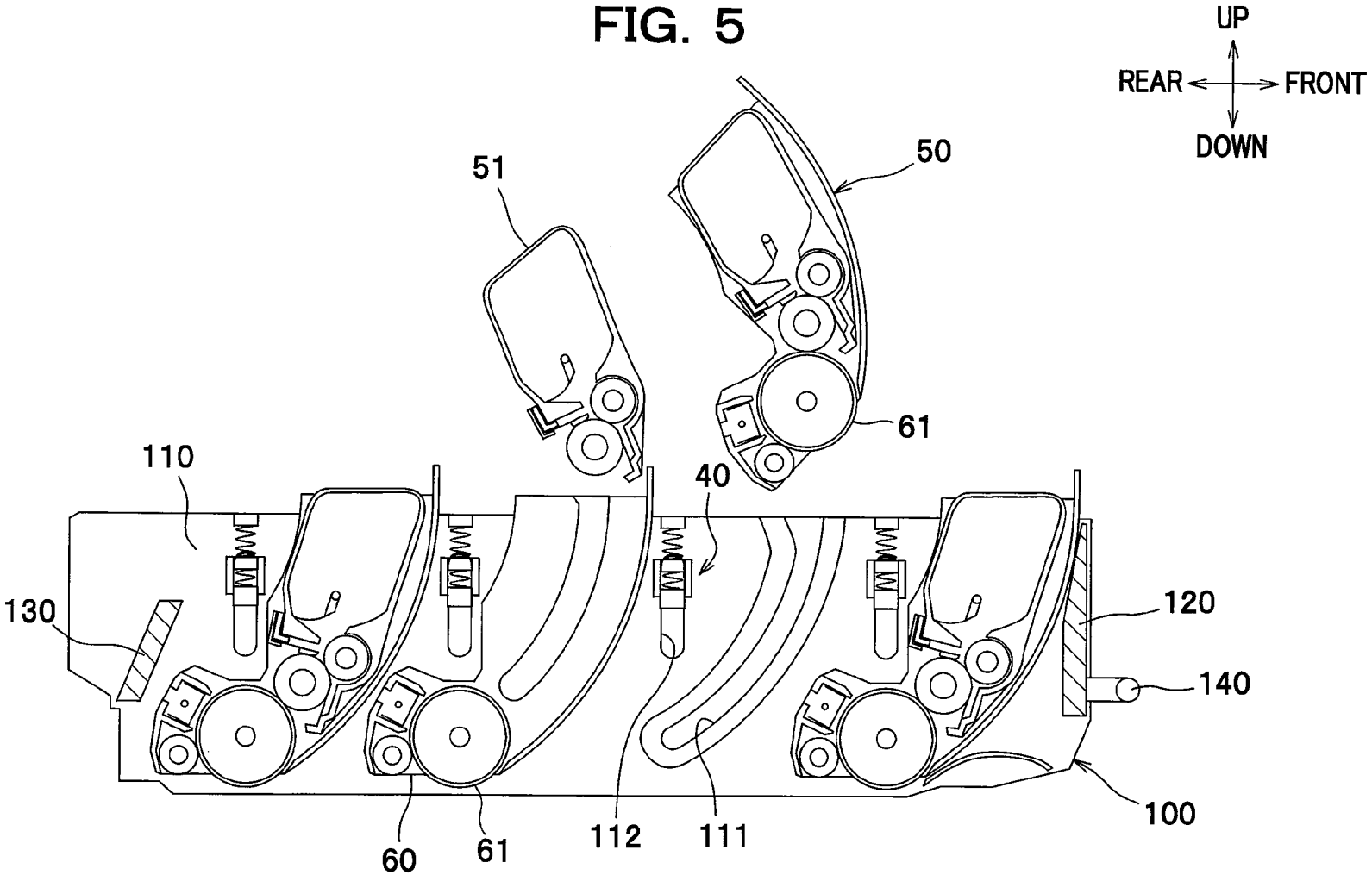
FIG. 5 is a sectional view showing the relationship between the drawer and process cartridges.

The drawer 100 has a pair of right and left side walls 110 disposed opposite to each other in the right-and-left direction (i.e., in the axial direction of the photoconductor drums 61), and configured to support the plurality of process cartridges 50 (plurality of photoconductor drums 61) and the plurality of LED arrays 40 between the side walls 110. As best seen in FIG. 5, the pair of side walls 110 are connected at their front end portions by a front wall 120 and at their rear portions by a rear wall 130. Further, a generally U-shaped handle portion 140 is provided on the front surface of the front wall 120 so that the user can grip the handle portion 140.

Arcuate grooves 111 are formed on the inner surface of each side wall 110, and each of the process cartridges 50 is guided along the corresponding groove 111 toward an exposure position at which each photoconductor drum 61 is exposed to light by the corresponding LED array 40. Accordingly, the process cartridge 50 is arcuately movable with respect to the drawer 100 and detachably mounted to the drawer 100.

Further, a plurality of oblong holes 112 are formed in each side wall 110; each oblong hole supports the LED array 40 while allowing an upward and downward movement of the LED array 40. The oblong hole 112 extends in the upward-and-downward direction, and for the purpose of guiding the LED array 40 between the exposure position and the retreating position the oblong hole 112 is engaged with an engageable portion 43A of the LED array 40 (see FIG. 6) to be described later.

Figure 6:
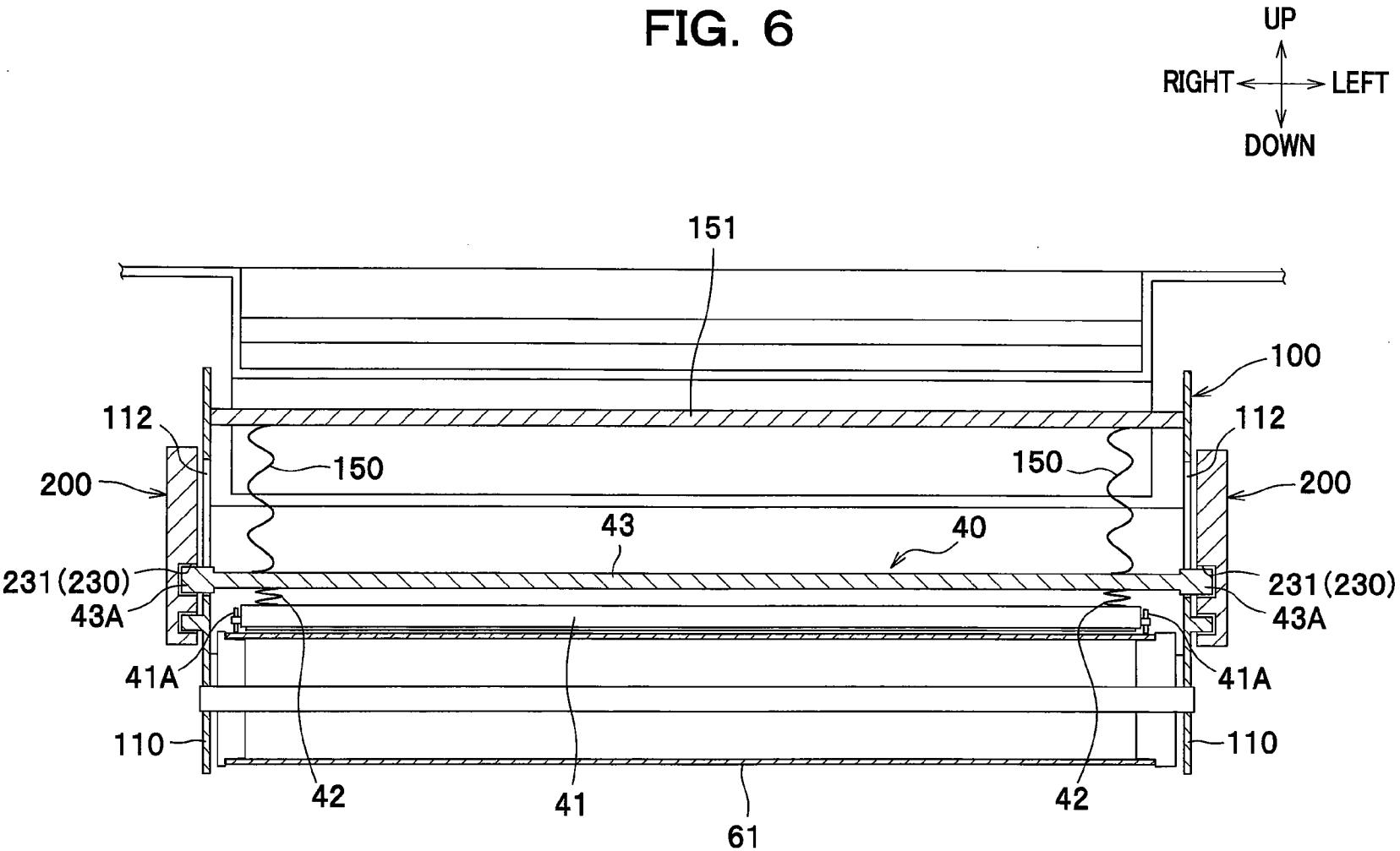
FIG. 6 is a sectional view of an LED array in the front-and-rear direction.

As best seen in FIG. 6, the LED array 40 includes an LED head 41 having a plurality of LEDs, a pair of coil springs 42 for urging the LED head 41 toward the photoconductor drum 61, and a support frame 43 for supporting the LED head 41 via the coil springs 42. The support frame 43 has an elongated shape extending in the right-and-left direction, and a pair of engageable portions 43A are provided at both end portions thereof. Each of the engageable portions 43A penetrates through the oblong hole 112 and extends outward in the right-and-left direction beyond the side wall 110.

The support frame 43 is supported by the drawer 100 via tension coil springs 150. To be more specific, the tension coil springs 150 are arranged between the support frame 43 and a supporting wall 151 which is fixed to and extending between the pair of side walls 110, and always urge the LED array 40 in a direction away from the photoconductor drum 61.

As seen in FIGS. 2-4 and 6, the pair of engageable portions 43A extending outward through the side walls 110 are brought into contact with the pair of guide members 200 provided outside the side walls 110, and pressed upward or downward by the guide members 200. The guide members 200 are provided in the main body casing 10 and configured to support the drawer 100 while allowing movement of the drawer 100 in the front-and-rear direction. In other words, the guide members 200 are relatively movable with respect to the drawer 100.

To be more specific, each guide member 200 includes a longitudinal plate-like body portion 210 extending in the front-and-rear direction, a drawer guide groove 220, and a guide groove 230.

The body portion 210 is arranged opposite to the side wall 110 of the drawer 100. The body portion 210 has two protruding pins 211 extending outward in the right-and-left direction; one protruding pin 211 is formed on a front lower portion of the body portion 210 and the other protruding pin 211 is formed on a rear lower portion of the body portion 210. These protruding pins 211 are supported by a pair of arcuate grooves 15 which are formed in a side frame 16 provided at each side of the main body casing 10.

With this configuration, the body portion 210 is movable between the position shown in FIG. 2 and the position shown in FIG. 3. To be more specific, the pair of body portions 210 are movably supported by the main body casing 10 such that the photoconductor drums 61 become movable between a contacting position in which the photoconductor drums 61 contact the conveyor belt 71 and a spaced-apart position in which the photoconductor drums 61 are away from the conveyor belt 71. Namely, according to this embodiment, the pins 211 formed on the pair of guide members 200 and two pairs of grooves 15 formed on the main body casing 10 constitute a separation mechanism configured to support the guide members 200 together with the drawer 100 such that the drawer 100 is movable at least in an upward-and-downward direction.

The drawer guide groove 220 is a groove for supporting the drawer 100 while allowing movement of the drawer 100 in the front-and-rear direction. The drawer guide groove 220 extends in the front-and-rear direction. To be more specific, the drawer guide groove 220 supports a pair of engagement pins 113A formed on a rear side of the side wall 110 of the drawer 100 and one engagement pin 113B formed on a front side of the side wall 110.

The drawer guide groove 220 has a pair of restriction surfaces 221, 222 for restricting movement of the pair of engagement pins 113A in the front-and-rear direction. With this configuration, a forward and rearward movement of the drawer 100 with respect to the guide members 200 can be restricted, and the drawer 100 can be positioned in the retracted position and in the pull-out position.

It is to be noted that the one engagement pin 113B formed on the front side of the side wall 110 of the drawer 100 has a length shorter than that of each of the engagement pins 113A so as to prevent the engagement pin 113B from being trapped by the restriction surface 221.

The guide groove 230 is a groove for guiding the engageable portion 43A such that the LED array 40 is guided from the retreating position to the exposure position when the drawer 100 is inserted into the main body casing 10. The rear end of the guide groove 230 is closed and the front end of the guide groove 230 opens outside. To be more specific, the guide groove 230 consists of an engagement portion 231 with which the engageable portion 43A is engaged when the LED array 40 is positioned in the exposure position, a guiding portion 232 by which the engageable portion 43A is allowed to move in the front-and-rear direction while the LED array 40 is in the retreating position, and a slanted portion 233 connecting the engagement portion 231 and the guiding portion 232.

The engagement portion 231 is shaped like a longitudinal groove extending in the front-and-rear direction, and an upward movement of the engageable portion 43A is restricted by an upper edge of the engagement portion 231. To be more specific, when the LED array 40 is positioned in the exposure position (i.e., position shown in FIG. 6 in which guide rollers 41A rotatably provided on the LED head 41 are brought into contact with the photoconductor drum 61), the LED head 41 is urged downward by the coil springs 42 and the engageable portion 43A is urged upward by the coil springs 42 and the tension coil springs 150. Therefore, since the engageable portion 43A contacts the upper edge of the engagement portion 231, the LED array 40 is positioned in the exposure position while being urged against the photoconductor drum 61 by a preferable urging force.

The guiding portion 232 is shaped like a longitudinal groove extending in the front-and-rear direction. The slanted portion 233 is shaped like a longitudinal groove slanting downward as it goes rearward. With this shape of the slanted portion 233, as the drawer 100 is inserted into the guide members 200 (main body casing 10), the engageable portion 43A is pressed downward by the upper edge of the slanted portion 233 to thereby cause the LED array 40 to move downward into the exposure position. On the contrary, as the drawer 100 is pulled out from the guide members 200 (main body casing 10), the engageable portion 43A is pressed upward by the lower edge of the slanted portion 233 or pressed upward by the urging force of the tension coil springs 150 to thereby cause the LED array 40 to move into the retreating position.

The interlocking mechanism 300 causes the guide member 200 to actuate in synchronization with the opening and closing operation of the front cover 12, so that when the front cover 12 is moved from the closed position to the opened position, the guide member 200 (photoconductor drums 61) is moved from the contacting position to the spaced-apart position. To be more specific, the interlocking mechanism 300 includes a sector member 310 fixed to the front cover 12, and a link member 320 connecting the guide member 200 and the sector member 310.

The sector member 310 has a sector shape whose center of curvature coincides with the axis of rotation 12A of the front cover 12. The sector member 310 is fixed to a lower end portion of the front cover 12 on each side (i.e., right side and left side) thereof.

The link member 320 has one end which is rotatably connected to the protruding pin 211 positioned at the front side of the guide member 200 and the other end which is rotatably connected to the sector member 310.

Accordingly, when the front cover 12 is opened, the pair of guide members 200 are pulled forward by the front cover 12 via the link members 320 and the sector members 310, so that the guide members 200 are moved diagonally upward and frontward along the arcuate grooves 15. When the front cover 12 is closed, the pair of guide members 200 are pressed rearward by the front cover 12 via the link members 320 and the sector members 310, so that the guide members 200 are moved diagonally downward and rearward along the arcuate grooves 15.

A rear portion of the drawer 100 and a rear portion of the guide member 200 extend into the space located at each side (i.e., right side and left side) of the sheet output tray portion 13. To be more specific, when the front cover 12 is closed and the color printer 1 is placed in condition ready for printing, the rear portion of the drawer 100 and the rear portion of the guide member 200 overlap with the sheet output tray portion 13 as viewed from side.

Accordingly, the upper wall 14 of the main body casing 10 can be lowered without changing the depth of the sheet output tray portion 13, which leads to miniaturization of the size (height) of the main body casing 10 in the upward-and-downward direction. Further, since part of the drawer 100 is arranged in the space located at each side of the sheet output tray portion 13, an upper front portion of the drawer 100 (upper portions of the process cartridges 50) and upper front portions of the pair of guide members 200 are arranged in a space below the second wall 132 of the sheet output tray portion 13 and the upper wall 14 of the main body casing 10. By this arrangement, it is possible to effectively utilize the space below the second wall 132 of the sheet output tray portion 13 and the upper wall 14 of the main body casing 10.

As seen in FIG. 4, a main body circuit board 600 is provided in the main body casing 10. The main body circuit board 600 is connected to the plurality of LED arrays 40 via a flat cable 400 and a relay board 500.

The main body circuit board 600 is disposed at a position below the conveyor belt 71 and the fixing unit 80. The main body circuit board 600 is configured to receive printing instructions outputted from a device such as a personal computer and to execute a control for converting image data contained in the printing instructions into driving signals to drive the LEDs.

The relay board 500 is a circuit board configured to output the driving signals outputted from the main body circuit board 600 to the LEDs. The relay board 500 is arranged at a rear side (i.e., at a downstream position in a direction in which the drawer 100 is inserted into the main body casing 10) of the left side wall 110 of the drawer 100.

The flat cable 400 includes a plurality of exposure member-side cables 410 extending from the plurality of LED arrays 40 to the relay board 500, and one main body circuit board-side cable 420 extending from the relay board 500 to the main body circuit board 600.

Each of the exposure member-side cables 410 is folded back and forth within the drawer 100 to form a corrugated portion 411. Accordingly, the movement of the LED array 40 in the upward-and-downward direction is allowed by the corrugated portion 411 of the exposure member-side cable 410.

Figure 7:
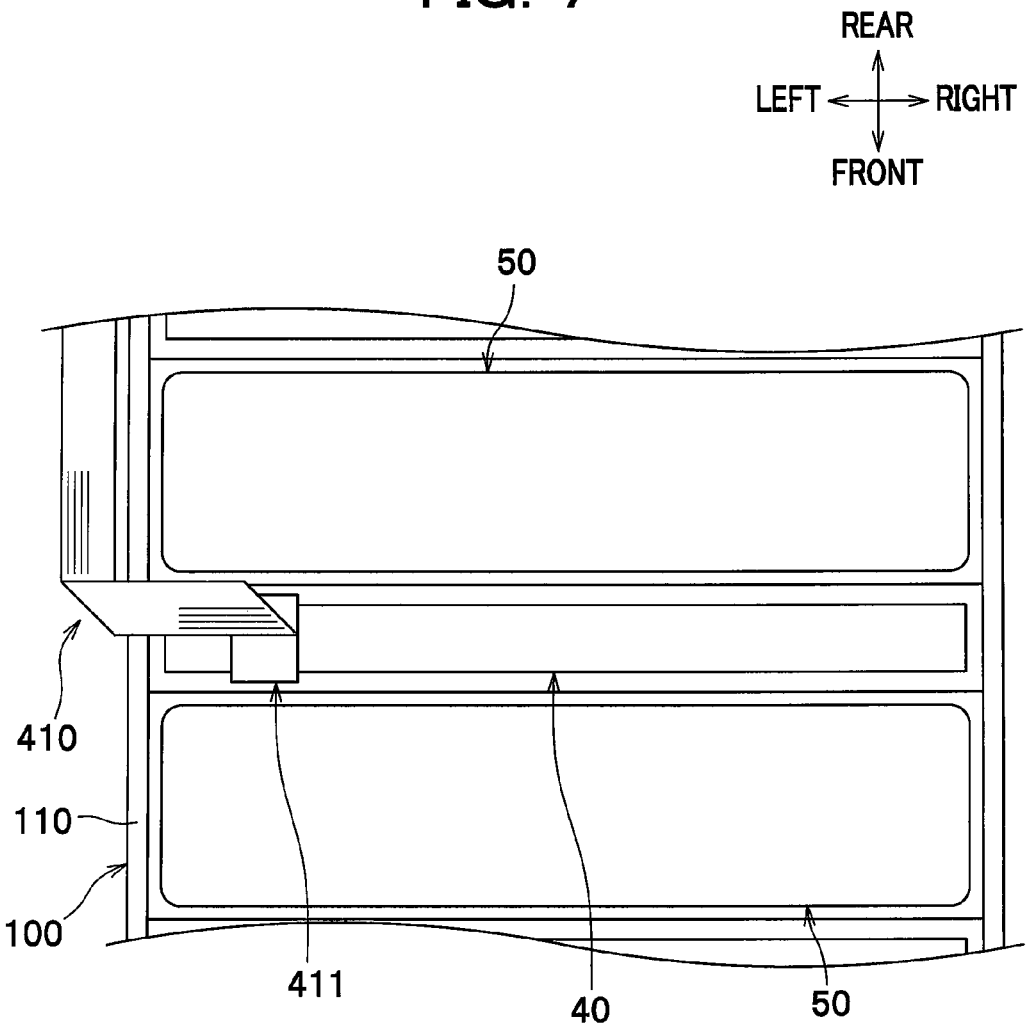
FIG. 7 is a top view schematically showing the relationship between an exposure member-side cable and the process cartridges.
Figure 8:
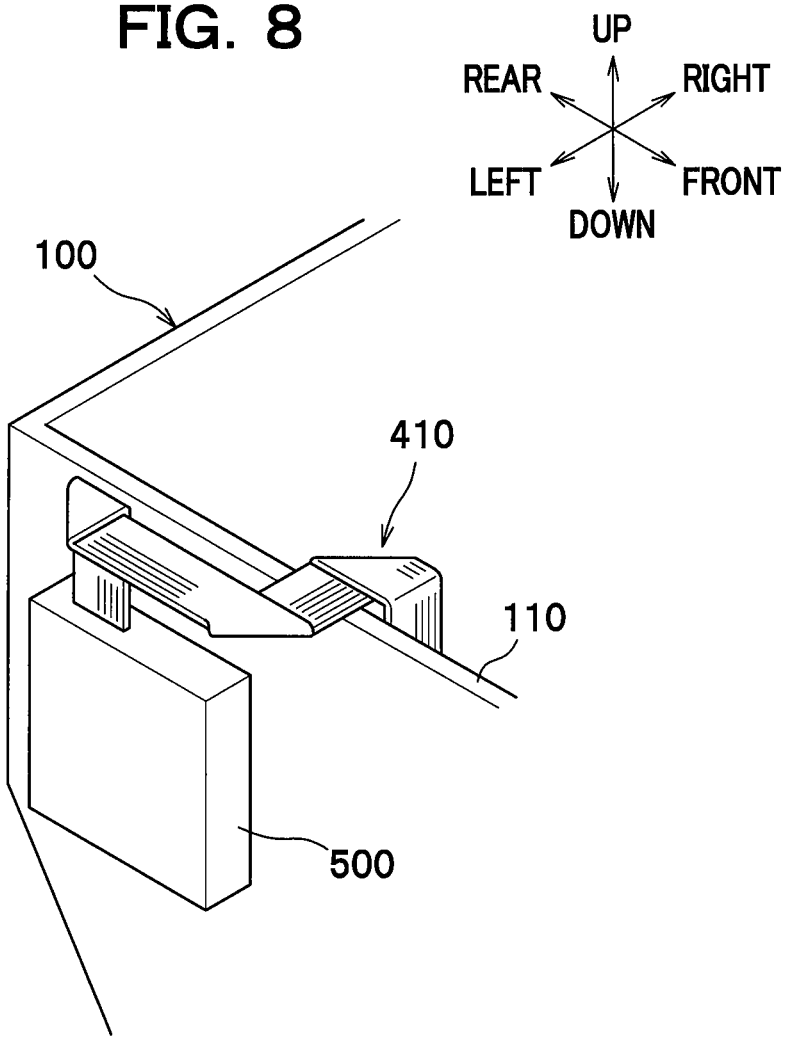
FIG. 8 is a perspective view schematically showing the exposure member-side cable.

As best seen in FIGS. 7 and 8, the exposure member-side cable 410 extends upward a short distance from the corrugated portion 411, and is folded in the right-and-left direction such that the cable 410 extends outward beyond the process cartridge 50. Thereafter, the cable 410 is folded such that the cable 410 extends toward the relay board 500 (toward the main body circuit board 600). This makes it possible to prevent the exposure member-side cable 410 from being an obstacle when the process cartridge 50 is attached to or removed from the drawer 100 from above.

In FIG. 7, the exposure member-side cable 410 extending from the LED array 40 that is located next to the rearmost LED array 40 is shown and the other exposure member-side cables 410 are omitted. Further, in FIG. 8, the exposure member-side cable 410 extending from the rearmost LED array 40 is shown and the other exposure member-side cables 410 are omitted.

To be more specific, the exposure member-side cable 410 extends upward from the corrugated portion 411 facing perpendicularly to the front-and-rear direction, and is folded rearward at right angles at a position higher than the side wall 110 of the drawer 100 and then folded outward in the right-and-left direction such that the cable 410 extends outward beyond the side wall 110 of the drawer 100. Thereafter, the exposure member-side cable 410 is folded rearward to make a 90-degree turn such that the cable 410 extends rearward, and then folded inside in the right-and-left direction and bent vertically at right angles such that the cable 410 extends downward. In this way, the exposure member-side cable 410 is connected to the relay board 500.

As best seen in FIG. 4, the main body circuit board-side cable 420 extends rearward from the relay board 500 along the inner surface (i.e., side surface) of the left-side guide member 200, and passes the guide member 200 from inside to outside through a through-hole 240 as an example of a pass-through portion formed substantially at a center of the guide member 200. The main body circuit board-side cable 420 then extends rearward to a position in the vicinity of the rear end portion of the guide member 200, and is folded downward. In this way, the main body circuit board-side cable 420 connects the relay board 500 and the main body circuit board 600.

To be more specific, the main body circuit board-side cable 420 includes a first extension portion 421 extending from the relay board 500 to the through-hole 240, a retained portion 422 extending from the rear end of the first extension portion 421 to the vicinity of the rear end of the guide member 200, and a second extension portion 423 extending from the rear end of the retained portion 422 to the main body circuit board 600.

Figure 9A:
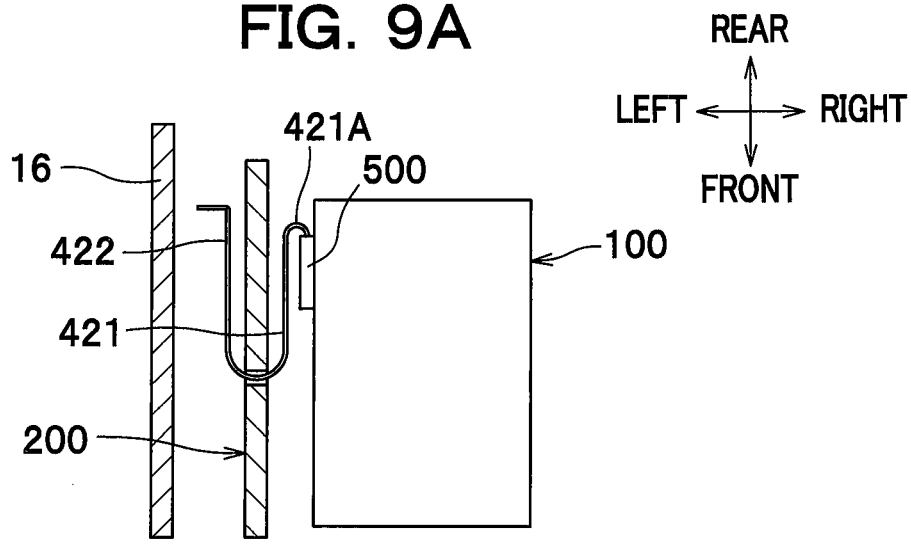
FIG. 9A is an explanatory view schematically showing a main body circuit board-side cable when the drawer is in a retracted position.

The first extension portion 421 is arranged between the retained portion 422 and the relay board 500 (LED arrays 40). The first extension portion 421 faces the inner surfaces of the guide members 200 and extends in the front-and-rear direction (in which the drawer 100 is rectilinearly moved). As best seen in FIG. 9A, the first extension portion 421 forms a slack portion 421A (i.e., loose and untensioned portion) which allows the movement of the drawer 100, when the drawer 100 is in the retracted position.

Figure 9B:
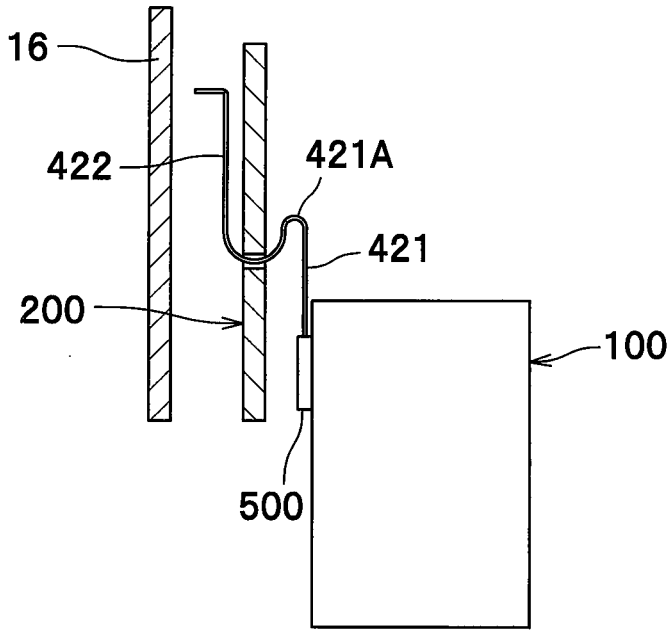
FIG. 9B is an explanatory view schematically showing the main body circuit board-side cable when the drawer is in a pull-out position.

The slack portion 421A is formed by folding the first extension portion 421 into a U-shape with its open end facing toward the front side and the two flat surfaces facing to each other. As best seen in FIGS. 9A and 9B, pulling out the drawer 100 forward from the retracted position causes the slack portion 421A to deform such that the bottom part of the U-shape changes its position, to thereby allow the movement of the drawer 100 without applying a high tension to the first extension portion 421.

As seen in FIG. 4, the retained portion 422 (a part of the main body circuit board-side cable 420) is arranged outside the pair of guide members 200 in the right-and-left direction; the front end of the retained portion 422 is retained by the through-hole 240 and the rear end thereof is retained by a retaining portion (not shown) provided on the guide member 200. Manner of retaining the retained portion 422 is not limited to a specific method, and any known methods may be used; for example, the retained portion 422 may be fixed by adhesive glue, nipped in a through-hole or nipped by a bifurcated portion.

The second extension portion 423 extends from the rear end of the retained portion 422 positioned outside the guide members 200 in the right-and-left direction, passing an outside region of the pair of guide members 200 and the conveyor belt 71 in the right-and-left direction, and is connected to the main body circuit board 600. In other words, the second extension portion 423 is arranged between the retained portion 422 and the main body circuit board 600.

Figure 10:
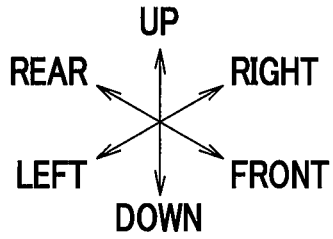
FIG. 10 is a perspective view schematically showing a retained portion and a second extension portion.
Figure 10:
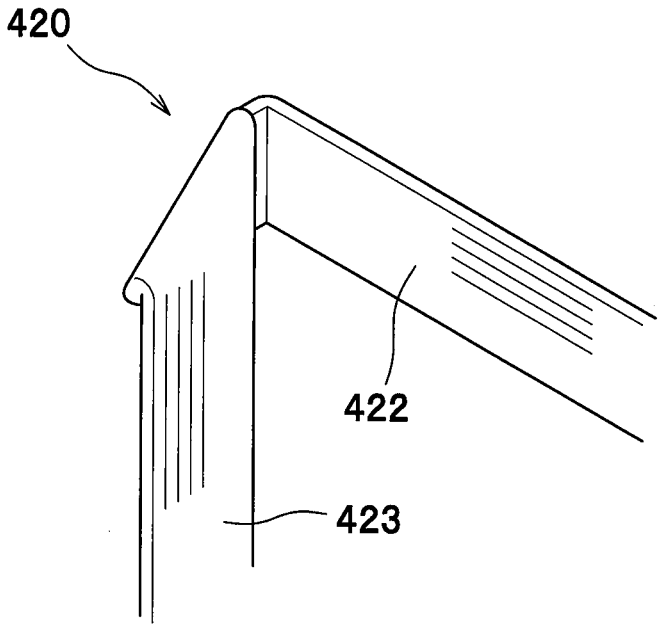

To be more specific, as best seen in FIG. 10, the second extension portion 423 is folded outward at right angles in the right-and-left direction at the rear end of the retained portion 422 and then folded downward, so that the second extension portion 423 extends downward and faces perpendicularly to the front-and-rear direction. With this arrangement, the second extension portion 423 is loosened and tensed in the front-and-rear direction without deforming in the right-and-left direction. Further, as best seen in FIG. 2, the second extension portion 423 has a slack portion 423A which allows the movement of the guide members 200 in the upward-and-downward direction when the LED arrays 40 are in the exposure position.

Since the flat cable 400 is configured as described above, when the guide members 200 are moved in the upward-and-downward direction, the first extension portion 421 and the retained portion 422 of the flat cable 400 are moved together with the guide members 200 and only the second extension portion 423 is deformed so as to be loosened and tensed in the thickness direction of the cable. Further, when the drawer 100 is moved in the front-and-rear direction, only the first extension portion 421 is deformed so as to be folded into or unfolded from the U-shape. Namely, deformation of the flat cable 400 in its width direction can be prevented both at a time of movement of the guide members 200 in the upward-and-downward direction and at a time of movement of the drawer 100 in the front-and-rear direction. Therefore, flexion of the flat cable 400 in the width direction can be avoided, which leads to suppression of fatigue fracture of signal cables.

With the configuration of the color printer 1 according to this embodiment, the following advantageous effects can be achieved.

Since the first extension portion 421 and the second extension portion 423 are each configured to allow only one-directional movement of the drawer 100, as compared with a structure in which two-directional movement is allowed by deformation of the whole flat cable (e.g., structure in which the flat cable is not retained by any member between the main body circuit board and the drawer), free movement of the flat cable 400 as a whole can be restricted. Accordingly, even if the distance between the main body circuit board 600 and the drawer 100 is large as with the arrangement of this embodiment, the trajectory of the flat cable 400 can be made smaller.

Since the first extension portion 421 is arranged to face the guide members 200, the color printer 1 can be miniaturized in a direction perpendicular to the guide members 200.

Since the retained portion 422 and the second extension portion 423 of the flat cable 400 are arranged outside the guide members 200, interference of the retained portion 422 and the second extension portion 423 with the drawer 100 can be avoided.

Since the second extension portion 423 is arranged perpendicular to the front-and-rear direction, the second extension portion 423 is loosened and tensed only in the front-and-rear direction and does not deform in the right-and-left direction. This can prevent interference of the second extension portion 423 with the conveyor belt 71 and other parts.

Providing the relay board 500 makes it possible to combine a plurality of exposure member-side cables 410 into one main body circuit board-side cable 420 via the relay board 500. Therefore, as compared with a structure in which a plurality of flat cables extending from a plurality of LED arrays are directly connected to the main body circuit board, the first extension portion 421 and the second extension portion 423 can be moved preferably. It should be noted that each of the cables connected to the LED arrays supplies electric power for driving the LED array as well as signals such as image data, and generally larger amount of power is supplied through the cable as compared with a cable for mainly transferring signals. If a main circuit board provided in the main body casing and the LED arrays are directly connected through the cables, the length of the cables for supplying large power has to be extended. However, according to the above preferred embodiment, since the relay board 500 is provided between the main body circuit board 600 and the LED arrays 40, the large electric power is supplied through the exposure member-side cables 410 extending between the relay board 500 and the LED arrays 40, which leads to reduction in noise generated in the exposure member-side cables 410.

Since the relay board 500 is provided on the drawer 100 at a downstream position in a direction in which the drawer 100 is inserted into the main body casing 10, the length of the flat cable 400 can be shortened as compared with a structure in which the relay board 500 is provided at an upstream position. Further, when the drawer 100 is pulled out from the main body casing 10, most (more than half region) of the relay board 500 is hidden in the main body casing 10. This can advantageously protect the relay board 500 and prevent the relay board 500 from being damaged.

Since the relay board 500 is provided on the side wall 110 which is an essential part for constituting the drawer 100, the weight of the drawer 100 can be reduced and the cost of the color printer 1 can be saved, as compared with a structure in which an additional member for installing the relay board is provided on the drawer.

Since the movement of the guide members 200 is interlocked with the front cover 12, the attachment/removal operation of the drawer 100 can be eased, as compared with a structure in which the guide members 200 are manually moved in the upward-and-downward direction after the front cover 12 is opened.

Since the LED arrays 40 are located in the drawer 100 when they are in the exposure position and in the retreating position, interference of the LED arrays 40 with other parts can be avoided and the drawer 100 can prevent the user from unintentionally contacting the LED arrays 40.

Although an illustrative embodiment of the present invention has been described in detail, the present invention is not limited to this specific embodiment. It is to be understood that various changes and modifications may be made without departing from the scope of the appended claims.

In the above embodiment, the LED arrays 40 are used as an example of exposure members. However, the present invention is not limited to this specific configuration. For example, a number of light emitting elements such as EL (electroluminescence) elements and phosphors may be arranged such that they are made to selectively emit light in accordance the image data. As an alternative, a number of optical shutters comprising liquid crystal elements or PLZT elements may be provided with respect to one optical source, and the time for opening and closing each of the optical shutters may be selectively controlled in accordance with the image data to thereby control the light from the optical source.

In the above embodiment, four pairs of oblong holes 112 formed in the pair of side walls 110 are employed as stopper portions for positioning the exposure members in the retreating position. However, the present invention is not limited to this specific configuration. For example, the exposure members may be engaged with parts other than the side walls.

In the above embodiment, the conveyor belt 71 for conveying a sheet P between the surface thereof and the photoconductor drums 61 is used as an example of a belt. However, the present invention is not limited to this specific configuration, and an intermediate transfer belt on which toner carried on the photoconductor drums is transferred may be used, instead.

In the above embodiment, the pins 211 formed on the pair of guide members 200 and the two pairs of grooves 15 formed on the main body casing 10 constitute a separation mechanism.

However, the present invention is not limited to this specific configuration. For example, a combination of the guide members and the link mechanism may constitute the separation mechanism. Further, a geared mechanism may be used to constitute an interlocking mechanism.

In the above embodiment, the through-opening 240 is used as an example of a pass-through portion. However, the present invention is not limited to this configuration. For example, the pass-through portion may be formed by an opening extending to the end of the side wall.

In the above embodiment, the color printer 1 is used as an example of an image forming apparatus. However, the present invention is applicable to other image forming apparatuses such as a copying machine and a multifunction printer.

What is claimed is:

1. An image forming apparatus comprising:

a plurality of photoconductor drums;

a plurality of exposure members each configured to expose a corresponding photoconductor drum to light to form an electrostatic latent image on the photoconductor drum;

a drum supporting member having a pair of side walls disposed opposite to each other in an axial direction of the photoconductor drum and configured to support the plurality of photoconductor drums and the plurality of exposure members between the side walls;

a belt disposed below and opposite to the photoconductor drums;

a pair of guide members configured to support the drum supporting member while allowing rectilinear movement of the drum supporting member between a retracted position in which the drum supporting member is received in a main body of the image forming apparatus and a pull-out position to which the drum supporting member is moved from the refracted position and pulled out from the main body through an opening formed in the main body;

a separation mechanism configured to move the guide members in an upward and downward direction such that the photoconductor drums supported by the drum supporting member are movable together with the drum supporting member between a contacting position in which the photoconductor drums contact the belt and a spaced-apart position in which the photoconductor drums are away from the belt; and a main body circuit board provided in the main body and connected to the plurality of exposure members via a flat cable, wherein the flat cable is partly supported at its retained portion by at least one of the guide members, and wherein each of the guide members has a pass-through portion through which the flat cable passes the guide member from inside to outside.

2. The image forming apparatus according to claim 1, wherein only one of the guide members retains the flat cable at the retained portion.

3. The image forming apparatus according to claim 1, wherein the flat cable has a first extension portion extending between the retained portion and each of the exposure members, and wherein the first extension portion faces the guide members and extends along a direction in which the drum supporting member rectilinearly moves, and the first extension portion has a slack portion which allows the rectilinear movement of the drum supporting member.

4. The image forming apparatus according to claim 1, wherein the flat cable has a second extension portion extending between the retained portion and the main body circuit board and having a slack portion which allows the movement of the guide members, and the retained portion and the second extension portion are arranged outside the guide members.

5. The image forming apparatus according to claim 4, wherein the second extension portion is arranged perpendicularly to the direction in which the drum supporting member rectilinear moves.

6. The image forming apparatus according to claim 1, wherein the drum supporting member supports a relay board configured to output driving signals to the plurality of exposure members, and wherein the flat cable comprises a plurality of exposure member-side cables extending from the plurality of exposure members to the relay board, and one main body circuit board-side cable extending from the relay board to the main body circuit board.

7. The image forming apparatus according to claim 6, wherein the relay board is provided on the drum supporting member at a downstream position in a direction in which the drum supporting member is inserted into the main body.

8. The image forming apparatus according to claim 6, wherein the relay board is provided on a side wall of the drum supporting member.

9. The image forming apparatus according to claim 1, wherein the main body has a cover movable between a closed position in which the opening is closed by the cover and an opened position in which the opening is left open, and wherein the image forming apparatus further comprises an interlocking mechanism configured to cause the cover and the separation mechanism to move in an interlocking manner such that when the cover is moved from the closed position to the opened position, the photoconductor drums are moved from the contacting position to the spaced-apart position.

10. The image forming apparatus according to claim 1, wherein the plurality of exposure members are supported by the drum supporting member so as to be movable between an exposure position in which the exposure members are positioned adjacent to the photoconductor drums and a retreating position in which the exposure members are away from the photoconductor drums and engaged with stopper portions, and wherein the exposure members are located in the drum supporting member when they are in the exposure position and in the retreating position.

11. The image forming apparatus according to claim 1, further comprising a plurality of developer receptacles each configured to store developer, a plurality of development rollers configured to supply developer stored in the developer receptacles to the photoconductor drums, and a plurality of process cartridges each including the photoconductor drum, and wherein each of the process cartridge is arcuately movable with respect to the drum supporting member and detachable from the drum supporting member.

12. An image forming apparatus comprising:

a plurality of photoconductor drums;

a plurality of exposure members each configured to expose a corresponding photoconductor drum to light to form an electrostatic latent image on the photoconductor drum;

a drum supporting member having a pair of side walls disposed opposite to each other in an axial direction of the photoconductor drum and configured to support the plurality of photoconductor drums and the plurality of exposure members between the side walls;

a belt disposed below and opposite to the photoconductor drums;

a pair of guide members configured to support the drum supporting member while allowing rectilinear movement of the drum supporting member between a retracted position in which the drum supporting member is received in a main body of the image forming apparatus and a pull-out position to which the drum supporting member is moved from the refracted position and pulled out from the main body through an opening formed in the main body;

a separation mechanism configured to move the guide members in an upward and downward direction such that the photoconductor drums supported by the drum supporting member are movable together with the drum supporting member between a contacting position in which the photoconductor drums contact the belt and a spaced-apart position in which the photoconductor drums are away from the belt; and a main body circuit board provided in the main body and connected to the plurality of exposure members via a flat cable, wherein the flat cable is partly supported at its retained portion by at least one of the guide members, wherein the drum supporting member supports a relay board configured to output driving signals to the plurality of exposure members, and wherein the flat cable comprises a plurality of exposure member-side cables extending from the plurality of exposure members to the relay board, and one main body circuit board-side cable extending from the relay board to the main body circuit board, and wherein the relay board is provided on a side wall of the drum supporting member.

* * * * *

UNITED STATES PATENT AND TRADEMARK OFFICE

CERTIFICATE OF CORRECTION

PATENT NO. : 8,594,530 B2
APPLICATION NO. : 13/349610
DATED : November 26, 2013
INVENTOR(S) : Shougo Sato et al.

It is certified that error appears in the above-identified patent and that said Letters Patent is hereby corrected as shown below:

Claims

In Column 13, Claim 1, Line 11:
Please delete "refracted" and replace with --retracted--

In Column 14, Claim 12, Line 47:
Please delete "refracted" and replace with --retracted--

Signed and Sealed this
Twenty-seventh Day of October, 2015

Michelle K. Lee

Michelle K. Lee
*Director of the United States Patent and Trademark Office*